United States Patent [19]

Abraham

[11] 4,314,453

[45] Feb. 9, 1982

[54] ONE AND A HALF BAND REFRIGERATED DISPLAY CASE

[75] Inventor: Fayez F. Abraham, Niles, Mich.

[73] Assignee: Tyler Refrigeration Corporation, Niles, Mich.

[21] Appl. No.: 76,669

[22] Filed: Sep. 18, 1979

Related U.S. Application Data

[63] Continuation-in-part of Ser. No. 60459, Jul. 25, 1979, and Ser. No. 70,882, Aug. 29, 1979.

[51] Int. Cl.[3] ..... F25D 21/12

[52] U.S. Cl. ..... 62/82; 62/256; 62/282

[58] Field of Search ..... 62/255, 256, 80, 82, 62/282

[56] References Cited

U.S. PATENT DOCUMENTS

| | | | |
|---|---|---|---|
| 3,289,432 | 12/1966 | Brennan et al. | 62/256 |
| 3,392,544 | 7/1968 | Perez | 62/256 |
| 3,528,258 | 9/1970 | Brennan | 62/256 |
| 3,675,440 | 7/1972 | Ibrahim | 62/255 |
| 3,898,864 | 8/1975 | Steelman | 62/80 X |
| 4,026,121 | 5/1977 | Aokage et al. | 62/256 X |

FOREIGN PATENT DOCUMENTS

| | | | |
|---|---|---|---|
| 2804008 | 8/1978 | Fed. Rep. of Germany | 62/256 |

*Primary Examiner*—William E. Tapolcai, Jr.
*Attorney, Agent, or Firm*—LeBlanc, Nolan, Shur & Nies

[57] ABSTRACT

A refrigerated display case for displaying refrigerated products. The display case is formed in a cabinet that has an interior area for holding the refrigerated products. The cabinet has an access opening either in its top wall or its front wall for enabling access to the refrigerated products. A first air conduit extends around the cabinet and has inlet and outlet air openings for directing air across the access opening in the cabinet. During a refrigeration cycle of operation, the air traveling through the first air conduit is refrigerated by a set of evaporator coils. A second air conduit extends partially around the cabinet along a path lying outwardly of the first air conduit. The second air conduit has an outlet opening positioned adjacent to the outlet opening of the first air conduit. During the refrigeration cycle, air is emitted from the outlet opening of the second air conduit along a path across the access opening of the cabinet but lying outwardly of the air emitted from the outlet opening of the first air conduit. The inlet opening of the second air conduit is positioned so as to open into the first air conduit at a location after the air has passed through the air circulating mechanism but before the air has passed through the evaporator coils. This display case can be operated either in a refrigeration mode of operation where the air is circulated in a forward direction through the first and second air conduits with the air passing through the first conduit being refrigerated or a defrost mode of operation where ambient air is circulated through the first and second air conduits in a reverse direction. During the defrost mode of operation, ambient air is drawn through the outlet openings into the first and second air conduits. The ambient air passing through the second air conduit helps to transfer heat to the air passing through the first air conduit and to the evaporator coils both by means of conduction and convection so as to assist in the defrosting of the evaporator coils.

22 Claims, 7 Drawing Figures

ONE AND A HALF BAND REFRIGERATED DISPLAY CASE

RELATED APPLICATIONS

The present application is a continuation-in-part of applications Ser. No. 60,459 entitled *OPEN TOP REFRIGERATED DISPLAY CASE HAVING AMBIENT AIR DEFROST,* filed July 25, 1979 and Ser. No. 70,882, entitled *MULTIBAND OPEN FRONT REFRIGERATED CASE WITH AIR DEFROST,* filed Aug. 29, 1979; both of these applications are hereby incorporated by reference. The present application is also related to patent application Ser. No. 25,350, entitled *OPEN TOP REFRIGERATED DISPLAY WITH STORAGE SECTION,* filed Mar. 30, 1979 in the names of Arthur Perez and Fayez Abraham; the contents of such application is hereby incorporated by reference.

BACKGROUND OF THE INVENTION

The present invention relates to open top refrigerated display cases having an ambient air defrost system. Both within the specification and the claims of the present application, all references to refrigeration apparatus or refrigeration operations are intended to include cooling both at a temperature below 32° F., such as associated with frozen food display cases, and in excess of 32° F., such as typically associated with dairy food and fresh meat display cases.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. By this manner of operation, it is possibly to avoid any significant frost buildup within the display case.

Typically within the prior art, there have been three different approaches emloyed for defrosting refrigerated display cases. The first approach involves the use of electric resistance heaters that are arranged adjacent to the refrigerated coils of the refrigeration mechanism. During a defrost cycle, these heaters supply heat in an effort to eliminate the frost buildup on the coils but also adds warmer air to the air conduit for circulation within the case. The particular technique is relatively simple both in its construction and operation. However, since the electrical heaters are high voltage heaters that utilize significant electricity during operation, with the rapidly increasing cost of electricity it has become extremely uneconomical to employ such systems. Furthermore, the warm air circulated in the case can raise the temperature of the case too high. Thus, attempts have been made to find other alternatives to such a system.

A second type of system circulates hot compressed gaseous refrigerant through the refrigeration coils during the defrost cycle. During the defrost cycle, a valve control mechanism shuts off the supply of refrigerant to the refrigeration coils and alternatively feeds superheated compressed gaseous refrigerant through the coils. This hot gas serves to melt any frost buildup that has occurred on the refrigeration coils but simultaneously provides heat within the air conduit which can be circulated through the display case, which again is disadvantageous. While this type of system does not suffer from the high cost of operation of the electrical heater defrost system, the heated gas system involves a relatively high construction cost. Due to the requirement that the system be able to selectively switch between the supply of heated gas and refrigerant to the refrigeration coils, a complicated valving structure must be provided. Such a mechanism significantly increases the cost of construction of the display case. In addition, the provision of such a complicated system only increases the number of complex parts capable of breaking down and necessitating costly repairs.

The third type of system employed for defrosting display cases relies upon ambient air. It is this general category with which the invention of the present application is concerned. One type of system that employes ambient air during the defrost cycle is exemplified by those embodiments illustrated in U.S. Pat. Nos. 3,403,525, 3,850,003 and 3,937,033, all to Beckwith, et al. Each of these systems uses fans separate from the main air circulating fans. These extra fans are turned on during the defrost cycle for pulling ambient air from outside of the display case into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cycle and are opened during the defrosting cycle. The Beckwith, et al. '003 patent indicates that the concepts described in U.S. Pat. Nos. 3,082,612 and 3,403,525 did not prove to be practical and hence were not commercially feasible.

Finally, a third type of ambient air defrosting system is shown in U.S. Pat. No. 4,144,720 to Subera, et al., which is assigned to the same assignee as the present application. In the foregoing patent application, an open front refrigerated display case having primary and secondary air conduits is disclosed. In this system, reversible fans are employed for reversing the direction of flow of air within the conduits and simultaneously drawing in air from outside of the display case.

Another system employing reversible fans for ambient air defrost is shown in U.S. Pat. No. 4,026,121. This patent, however, refers to short-circuiting the air flow between the primary and secondary air bands for the purpose of supplying warmer air to the primary band.

It has been recognized that an ambient air defrost operation can be incorporated into an open top refrigerated display case as disclosed in U.S. Pat. No. 4,120,174 to Johnson. The Johnson patent illustrates an open top case having a single air conduit extending around the case. During the refrigeration cycle, the air flows in a first direction and during the defrost cycle the direction of the air flow is reversed with ambient air being drawn into the conduit. The quantity of air flow during the defrost cycle is greater than during refrigeration. The defrost air, after passing through the conduit, is expelled in a direction up and over the refrigerated case.

During the defrost operation, as the ambient air passes through the air conduit containing the evaporator coils such air is initially cooled by the frost buildup that exists on the coils. In addition, the air flow is significantly restrained since the openings between the coils are often substantially blocked. While in the multiband display cases the ambient air passing through the second air conduit that encircles the case helps in the defrost operation, such a secondary air conduit requires the utilization of additional fans for circulating the air as well as additional materials for purposes of construction. Consequently, both the single band and multiband display cases have certain inherent drawbacks and it, therefore, has been necessary to make a tradeoff in efficienty and costs between the two types of display cases.

Display cases having a full primary air conduit in which the evaporator coils are located and a partial secondary air conduit have been previously known. The partial secondary conduit has been utilized in order to provide a protective air curtain across the access opening for insulating the primary air curtain established by the refrigeration air conduit from the ambient air outside of the display case. Such display cases, however, have utilized electric defrost techniques for defrosting the evaporator coils. While a secondary protective screen is provided, there has been very little, if any, known advantages to the utilization of such a display case with respect to the resulting efficiency of operation.

SUMMARY OF THE INVENTION

An object of the present invention is to provide an improved refrigerated display case utilizing an ambient air defrost operation.

Another object of the present invention is to provide an improved refrigerated display case in which a secondary protective air screen can be provided across the access opening without the requirement of a separate set of fans.

A further object of the present invention is to provide an improved refrigerated display case in which additional ambient air can be drawn into the air conduit surrounding the case for assisting in the defrosting of the evaporator coils without any requirement for an additional set of fans.

Still another object of the present invention is to provide a refrigerated display case having a primary refrigerated air conduit circling the case and a partial secondary air conduit wherein during a defrost operation ambient air passes through both air conduits and the ambient air passing through the secondary conduit transfers heat to the air passing through the first air conduit by convection and condution.

Still a further object of the present invention is to provide a one and a half band refrigerated display case utilizing an ambient air defrost operation.

A still further object of the present invention is to provide an improved one and a half band refrigerated display case utilizing an ambient air defrost operation and operating with increased efficiency.

These objectives can be achieved by the utilization of a one and a half band refrigerated display case that is defrosted with the utilization of ambient air. The display case is formed in a cabinet having an interior display space with an access opening in either a top or front wall for enabling access to refrigerated products within the display case. A first air conduit extends around the cabinet so as to have an outlet opening at one end of the access opening and an inlet opening at the other end of the access opening. The inlet and outlet openings of the first air conduit are aligned so that air leaving the outlet opening is directed across the access opening and received by the inlet opening. A refrigeration mechanism, which is formed by either a single evaporator coil or a set of evaporator coils, is arranged within the first air conduit for refrigerating the air passing through such conduit.

Air is circulated through the first air conduit by a set of fans. The number of fans depends on the lateral length of the conduit and the sizes of the fans. Typically, two fans are used for an eight foot long case and three fans for a twelve foot long case. The air is circulated through the first air conduit in a forward direction during a refrigeration cycle of operation so that air is expelled from the outlet opening, travels across the access opening and then returns into the first air conduit through the inlet opening. During a defrost cycle of operation, the air is circulated through the first air conduit in a reverse direction so that the air is expelled from the inlet opening.

A second air conduit extends partially around the cabinet in a position lying outwardly of the first air conduit. The second air conduit has an outlet opening arranged adjacent to the outlet opening of the first air conduit. The second air conduit has an air inlet opening located so as to open into the first air conduit in order that during a refrigeration cycle of operation such inlet opening receives air passing through the first air conduit before such air passes through the refrigeration mechanism.

A control mechanism switches the display case between a refrigeration cycle of operation and a defrost cycle of operation. During the defrost cycle of operation, the operation of the refrigeration mechanism is temporarily terminated and the fans serve to circulate air through the first air conduit in a reverse direction for causing ambient air to be drawn into the outlet openings of the first and second air conduits and circulated through such conduits.

The ambient air circulated through the second air conduit during a defrost cycle of operation serves to transfer heat to the air passing through the first air conduit for assisting in the defrosting of the evaporator coil. Such heat is transferred both by conduction through the common wall shared by the first and second air conduit and by convection when the ambient air from the second air conduit mixes with the air passing through the first air conduit in the area between the fans and the evaporator coil. In addition, the inlet opening of the second air conduit can be arranged so that the ambient air passing through the second air conduit during a defrost cycle of operation will come into contact with a portion of the evaporator coil for assisting in defrosting such coil.

The air flow through the first air conduit is partially restricted due to the existence of the evaporator coil within the conduit. Such restriction or resistance to the air flow exists even if there is no frost buildup on the evaporator coil. If the first and second air conduits both have the same cross sectional dimensions there would be a natural tendency for the air to flow in greater quantity through the second air conduit than the first air conduit during a refrigeration cycle of operation. In order to prevent this natural tendency and to provide a better balance of the air flow between the conduits, the first air conduit is provided with a greater cross sectional area. In accordance with one preferred embodiment of the present invention, the cross sectional area of the first air conduit is three square feet while the cross sectional area of the second air conduit is two square feet. In order to provide additional resistance to the air flow through the second air conduit, a screen with a plurality of perforations can be provided within the second air conduit.

The first and second air conduits are constructed so that the volume of air flowing through the second air conduit during at least a portion of the defrost cycle of operation is greater than the volume of air flowing through the second air conduit during a refrigeration cycle of operation. In this manner, a greater quantity of ambient air passes through the air conduits than would otherwise be possible. In this regard, it must be taken into consideration that at the start-up of the defrost cycle of operation the accumulation of frost on the evaporator coils significantly restricts the air flow through the first air conduit thereby causing the volume of such air flow to be extremely diminished.

During the refrigeration cycle of operation, the volume of air flowing through the second air conduit should be approximately one-third of the volume of air flowing through the first air conduit. During the defrost cycle of operation, on the other hand, the volume of air flowing through the second air conduit should be at least one-half of the volume of air flowing through the first air conduit. In accordance with a preferred embodiment of the present invention in connection with an open top refrigerated display case, the volume of air flowing through the first air conduit during the refrigeration cycle of operation is between 350 and 425 CFM and in one embodiment was 388 CFM. The air flow through the second air conduit during the refrigeration cycle of operation is preferably between 125 and 150 CFM, and in one embodiment was 135 CFM. The total air flow during refrigeration is preferably between 475 and 575 CFM. During the defrost cycle of operation, the air flow through the first air conduit is between 200 and 300 CFM while the air flow through the second air conduit is between 125 and 175 CFM. In accordance with one embodiment, at the start-up of the defrost cycle of operation, the air flow through the first air conduit was 224 CFM and through the second air conduit 132 CFM. Immediately before the termination of the defrost cycle of operation, in accordance with such embodiment, the air flow through the first air conduit was 271 CFM and through the second air conduit 161 CFM.

DESCRIPTION OF THE PREFERRED EMBODIMENTS

Figure 1:
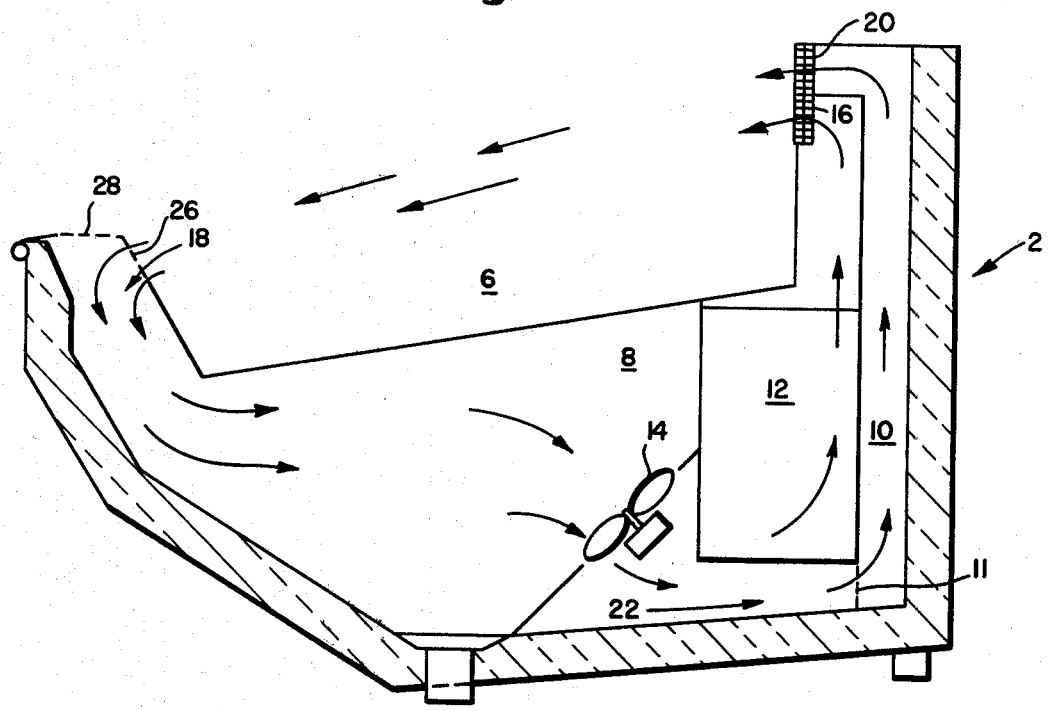
FIG. 1 is a side elevational partial sectional view of a top display refrigerated case in accordance with the present invention with the case being operated in a refrigeration cycle of operation.

An open top display case 2 having an opening 4 for providing access into an interior display space 6 is illustrated in FIG. 1. Display case 2 has a first air conduit 8 that extends around the case and a partial second air conduit 10. Arranged within first air conduit 8 is a refrigeration mechanism 12 formed by either a single or set of evaporator coils, and at least one fan 14 for circulating air through the conduit.

During a refrigeration cycle of operation of display case 2, air is circulated through air conduit 8 in a forward direction and is refrigerated by evaporator coil 12. The refrigerated air is emitted from conduit 8 through outlet opening 16 so as to be directed across access opening 4 and returned to conduit 8 through inlet 18. As air is circulated through conduit 8, a portion of such air also is circulated through the second air conduit 10. In order to control the flow of air through conduit 10, a screen 11 having a plurality of openings is arranged in conduit 10. Conduit 10 has an outlet opening 20 which is arranged adjacent to outlet opening 16 and directs a stream of air across access opening 4 of display case 2. Conduit 10 also has an inlet opening 22 which receives air circulated by fan 14.

The curtain of air provided by the air emitted through opening 20 of second air conduit 10 provides a protective barrier for protecting the refrigerated air emitted through opening 16 of conduit 8. This protective barrier insulates the refrigerated air both from the temperature of the ambient air surrounding the display case and from the moisture in such ambient air. In this manner, the products within the display case can be maintained at a colder temperature with a more efficient operation. The refrigerated air band also picks up less moisture from the ambient air thereby leading to less frost buildup on the evaporator coils and making it possible to defrost the display case less often. Typically, with the utilization of such a protective air band, it is possible to only have to defrost the display case once a day instead of twice a day.

During this refrigeration cycle of operation, the air emitted from outlet opening 16 is preferably between 17° and 27° F. in a medium temperature display case and desirably approximately 22° F. The temperature of the air emitted from outlet opening 20 for a medium temperature display is preferably between 33° and 43° F. and desirably approximately 38° F. The air received by inlet opening 18 is approximately 10° to 12° higher than the air emitted from outlet opening 16 and thus, is approximately between 30° and 40° F. and desirably approximately 35° F.

During the refrigeration cycle of operation, the volume of air flowing through the evaporator coil and the portion of air conduit 8 subsequent to the evaporator coil is between 350 and 425 CFM. The volume of air flowing through air conduit 10 is between 125 and 150 CFM. Consequently, the total air flow through the conduits is between 475 and 575 CFM.

Figure 2:
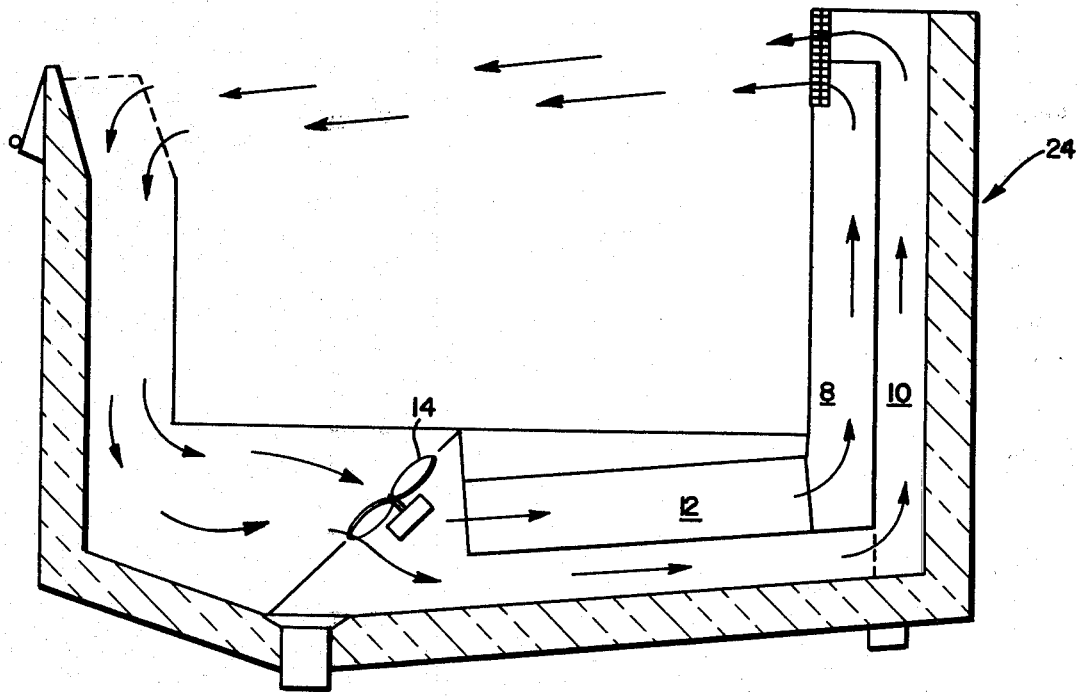
FIG. 2 is a side elevational partial sectional view of a well-type refrigerated display case in accordance with the present invention with the case being operated in a refrigeration cycle of operation.

A well-type refrigerated display case 24 is shown in FIG. 2. Well case 24 has a first air conduit 8 and a second air conduit 10. Arranged within first air conduit 8 are refrigeration mechanism 12 and fan 14. The operation of well display case 24 is the same as top display case 2 illustrated in FIG. 1.

Figure 3:
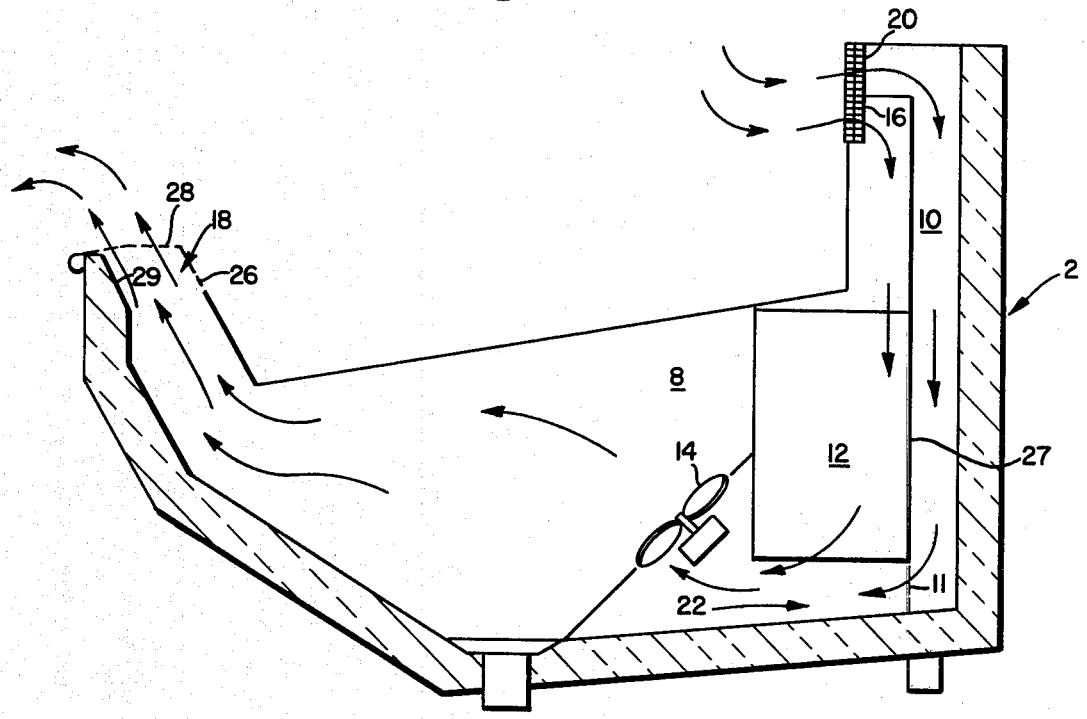
FIG. 3 is a view similar to FIG. 1 except that the display case is being operated in a defrost cycle of operation.
Figure 4:
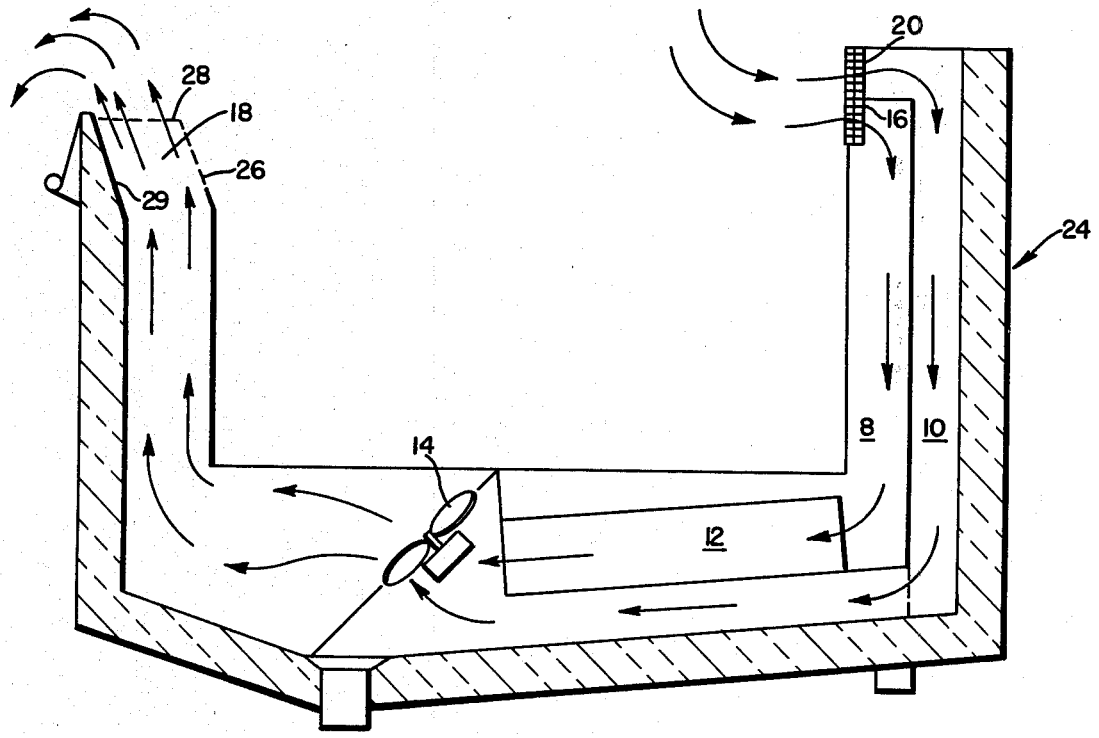
FIG. 4 is a view similar to FIG. 2 except that the display case is being operated in a defrost cycle of operation.

Top display case 2 and well display case 24 are shown in their defrost cycles of operation in FIGS. 3 and 4, respectively. During the defrost cycles of operation, ambient air is drawn into air conduits 8 and 10 through outlet openings 16 and 20, respectively. During this defrost cycle of operation, the refrigeration mechanism, i.e. the evaporator coil, is temporarily turned off so that the air passing through air conduit 8 is not refrigerated. Of course, some refrigeration of the air passing through conduit 8 still occurs due to the frost buildup on the coils of the refrigeration mechanism 12. The air is circulated through the air conduits by reversing the direction of fan 14 and hence, a reverse air flow path is established. The ambient air flowing through the conduits is expelled through outlet opening 18 of air conduit 8.

Outlet opening 18 is covered by a grid having two portions 26 and 28. Portion 26 receives the air directed across access opening 4 during a refrigeration cycle of operation. During the defrost cycle of operation, however, the air is expelled through portion 28 so as to be directed up and away from the display case. In order to cause the air to be directed away from the display case, the upper inner wall portion 29 of air conduit 8 is sloped in an outwardly direction. Additionally, an internal baffle for directing the air can be provided.

The ambient air passing through air conduit 10 assists in the defrosting of refrigeration mechanism 12. The heat of the ambient air passing through conduit 10 is transferred to the air passing through conduit 8 and refrigeration mechanism 12, first by conduction through the common wall 27 between the two conduits. In addition, after the ambient air leaves air conduit 10, it mixes with the air that has passed through refrigeration mechanism 12 and increases the temperature of such air before it passes through the fan. This increase in the temperature of the air is transferred back to the air passing through the refrigeration mechanism by convection. Furthermore, a portion of the ambient air passing through conduit 10 contacts a portion of refrigeration mechanism 12 for defrosting such portion, such as shown in FIG. 3.

During a defrost cycle of operation, the air flow through that portion of the first air conduit containing the refrigeration mechanism is preferably between 200 and 300 CFM. The air flow through the second air conduit during such defrost cycle is preferably between 125 and 175 CFM. In accordance with one embodiment the air flow through the refrigeration mechanism portion of the first air conduit is 224 CFM at the start of the defrost cycle and 271 CFM immediately before termination of the defrost cycle of operation. In the same embodiment, the air flow through the second air conduit was 132 CFM at the start of the defrost cycle and 161 CFM immediately before termination of the defrost cycle.

Figure 5:
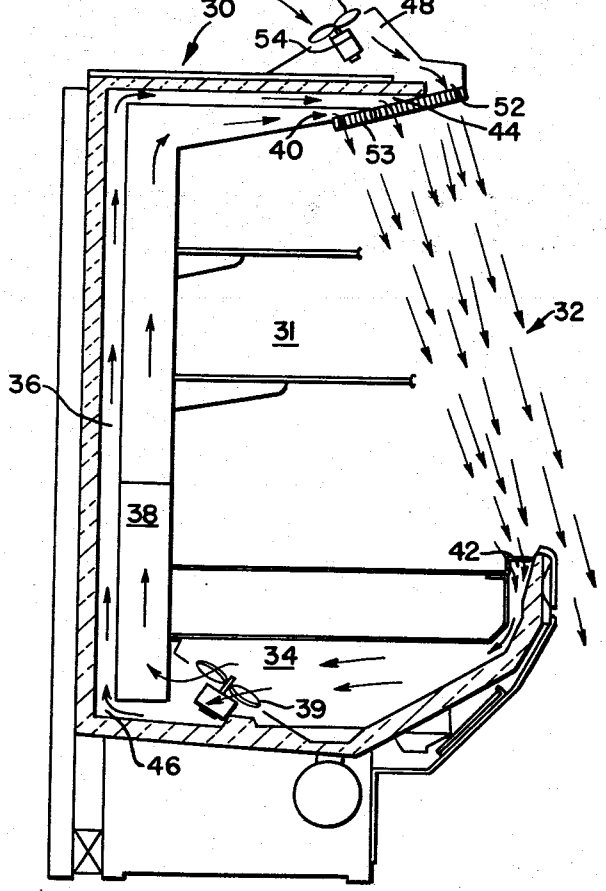
FIG. 5 is a side elevational partial sectional view of an open front refrigerated display case in accordance with the present invention with the case being operated in a refrigeration cycle of operation.

An open front refrigerated display case 30 having a front access opening 32 with an interior display space 31 is shown in FIG. 5. Display case 30 has a first air conduit 34 and a second conduit 36. Arranged within the first air conduit are a refrigeration mechanism 38 and at least one fan 39. First air conduit 34 has an outlet opening 40 at the top of the access opening and an inlet opening 42 at the bottom of the access opening. Outlet opening 40 and inlet opening 42 are aligned so that air emitted from the outlet opening will travel across the access opening and be received back into the first air conduit through the inlet opening. The second air conduit has an outlet opening 44 that is arranged adjacent to outlet opening 40. Second air conduit 36 also has an inlet opening that is located so as to open into the first air conduit and to receive air passing through fan 39 before it has passed through refrigeration mechanism 38.

A third air conduit 48 is located at the top of refrigerated display case 30. This third air conduit serves to provide an ambient protective air curtain across the front of the display case such as shown by the arrows in FIG. 5. The display case in FIG. 5 is shown during its refrigeration mode of operation. Air conduit 48 has an inlet opening 50 and an outlet opening 52. A fan 54 draws ambient air through the air conduit and expels it from outlet opening 52.

A common grid 53 can be arranged across the outlet openings of air conduits 34, 36 and 48. Alternatively, separate grids can be used for covering each of the outlet openings.

Figure 6:
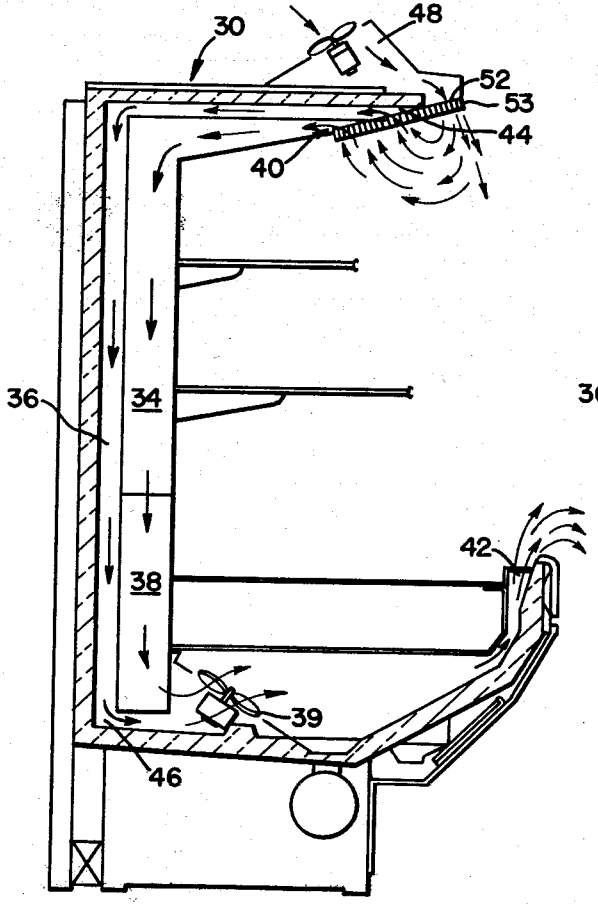
FIG. 6 is a view similar to FIG. 5 except that the display case is being operated in a defrost cycle of operation.

During a refrigeration cycle of operation, the air flow through conduits 34 and 36 of display case 30 is reversed by reversing the direction of operation of fan 39. The air flow through conduit 48, however, can be maintained. Thus, as shown in FIG. 6, the ambient air flowing through air conduit 48 is drawn into air conduits 34 and 36 for circulation through such conduits. The ambient air passing through conduit 34 serves to defrost the frost buildup on refrigeration mechanism 38. Additionally, the ambient air passing through air conduit 36 by convection and conduction transfers heat to the air passing through refrigeration mechanism 38 for defrosting such mechanism. Furthermore, a portion of the air emitted from inlet opening 46 of second air conduit 36 passes in contact with refrigeration mechanism 38, such as shown in FIG. 6, for defrosting such portion of the mechanism.

Figure 7:
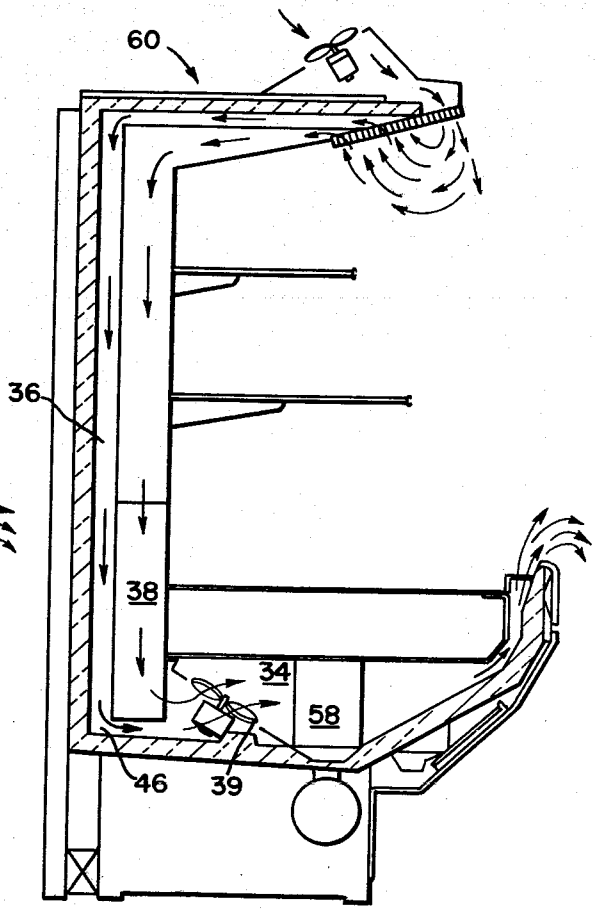
FIG. 7 is a side elevational partial sectional view of a modified embodiment of an open front refrigerated display case in accordance with the present invention with the case being operated in a defrost cycle of operation.

In a modified embodiment of an open front refrigerated display case 60, an additional evaporator coil 58 can be employed. Such an optional evaporator coil can be located on the opposite side of fan 39 from the evaporator coil of refrigeration mechanism 38. In such an embodiment, which is illustrated in FIG. 7, the ambient air passing through second air conduit 36 would serve to help defrost any frost buildup on evaporator coil 58.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What I claim is:

1. A refrigerated display case for displaying refrigerated products, said display case comprising:

a cabinet having an interior display space and an access opening for enabling access to refrigerated products within said display case;

a first air conduit extending around said cabinet so as to have an inlet opening at one end of said access opening and an outlet opening at the other end of said access opening, said inlet and outlet openings being aligned so that air leaving said outlet opening is directed across said access opening and received by said inlet opening;

refrigeration means including an evaporator coil arranged within said first air conduit for refrigerating air passing through said first air conduit;

air circulating means arranged within said first air conduit for circulating air through said first air conduit in a forward direction during a refrigeration cycle of operation so that air is expelled from said outlet opening, travels across said access opening and returns into said first air conduit through said inlet opening and for circulating such air in a reverse direction during a defrost cycle of operation so that air is expelled through said inlet opening;

a second air conduit extending partially around said cabinet in a position lying outwardly of said first air conduit, said second air conduit having an outlet opening arranged adjacent to said outlet opening of said first air conduit and an air inlet opening located so that during a refrigeration cycle of operation such inlet opening receives air passing through said first air conduit before such air passes through said refrigeration means and said inlet opening of said second air conduit being positioned such that a reverse air flow through said second air conduit during a defrost cycle of operation will flow in contact with a portion of said evaporator coil; and control means for switching between a refrigeration cycle of operation and a defrost cycle of operation and during such defrost cycle of operation temporarily terminating the operation of said refrigeration means and causing said air circulating means to circulate air through said first air conduit in a reverse direction for causing ambient air to be drawn into said outlet openings of said first and second air conduits and circulated through said first and second air conduits.

2. A refrigerated display case according to claim 1 wherein said access opening is arranged in a top wall of said cabinet.

3. A refrigerated display case according to claim 1 wherein said access opening is located in a front wall of said cabinet.

4. A refrigerated display case according to claim 3 further comprising a third air conduit lying outwardly of said second air conduit and having an outlet opening for directing air along a path lying outwardly of the air emitted from said outlet openings of said first air conduit and said second air conduit and said third air conduit having an inlet opening for drawing in ambient air for passage through said third air conduit.

5. A refrigerated display case according to claim 2, 3 or 4 wherein during a defrost cycle of operation, the air flowing through said first air conduit is emitted from said first air conduit through said inlet opening of said first air conduit in a direction away from said display case and said second air conduit is arranged so that the ambient air flowing through said second air conduit during a defrost cycle of operation assists in the defrosting of said refrigeration means by transferring heat to the air flowing through said first air conduit by conduction and convection.

6. A refrigerated display case according to claim 1, 2, 3 or 4 further comprising means arranged within said second air conduit for partially restricting the flow of air therethrough during a refrigeration cycle of operation such that the resistance to such air flow is at least as great as the resistance to air flow through said refrigeration means in said first air conduit when said refrigeration means is substantially free of frost buildup.

7. A refrigerated display case according to claim 1, 2, 3 or 4 wherein said air circulating means includes at least one fan arranged within said first air conduit and said fan is arranged so that during a defrost cycle of operation it draws in air through said outlet openings of said first air conduit and said second air conduit for circulation through said first air conduit and said second air conduit.

8. A refrigerated display case according to claim 1 wherein said first air conduit and said second air conduit are constructed such that the volume of air flowing through said second air conduit during at least a portion of a defrost cycle of operation is greater than the volume of air flowing through said second air conduit during a refrigeration cycle of operation.

9. A refrigerated display case according to claim 1 wherein said first air conduit and said second air conduit are constructed such that during a refrigeration cycle of operation, the volume of air flowing through said second air conduit is approximately one-third of the volume of air flowing through said first air conduit and during a defrost cycle of operation the volume of air flowing through said second air conduit is at least one-half of the volume of air flowing through said first air conduit.

10. A refrigerated display case according to claim 1 wherein said air circulating means causes a lower total volume of air flow through said first and second air conduits during a defrost cycle of operation than during a refrigeration cycle of operation.

11. A refrigerated display case according to claim 1 wherein said refrigeration means includes an evaporator coil and further comprising a second evaporator coil arranged within said first air conduit in a location prior to said inlet opening of said second air conduit.

12. A method of operating a refrigerated display case for displaying refrigerated products where the display case includes a cabinet having an interior display space and an access opening for enabling access to refrigerated products within the display case, a first air conduit extending around the cabinet and having inlet and outlet openings at opposing ends of the access opening, an evaporator coil arranged within the first air conduit for refrigerating the air passing through such conduit, at least one fan for circulating air through the conduit, a second air conduit extending partially around the cabinet in a position lying outwardly of the first air conduit and having an outlet opening arranged adjacent to the outlet opening of the first air conduit and an inlet opening arranged so that during a refrigeration cycle of operation such inlet opening receives air passing through the first air conduit before the air has passed through the evaporator coil; said method comprising the steps of:

circulating air in a first direction through the first air conduit and the second air conduit during a refrigeration cycle of operation so that air is expelled from the outlet openings of the first and second air conduits and returned to the first air conduit through its inlet opening;

refrigerating the air circulating through the first air conduit during a refrigeration cycle of operation;

circulating air through the first air conduit and the second air conduit in a reverse direction and temporarily terminating the operation of refrigerating the air during a defrost cycle of operation and causing ambient air to be drawn into the outlet openings of the first air conduit and the second air conduit for defrosting the evaporator coil;

transferring heat from the ambient air passing through the second air conduit to the air passing through the first air conduit during a defrost cycle of operation by conduction and convection; and, causing a portion of the reverse air flowing through the second air conduit to flow in contact with a portion of the evaporator coil for defrosting such coil.

13. A method according to claim 12 wherein the volume of air flowing through the second air conduit during at least a portion of a defrost cycle of operation is greater than the volume of air flowing through the second air conduit during a refrigeration cycle of operation.

14. A method according to claim 12 wherein the volume of air flowing through the second air conduit during a refrigeration cycle of operation is approximately one-third of the volume of air flowing through the first air conduit during a refrigeration cycle of operation and the volume of air flowing through the second air conduit during a defrost cycle of operation is at least one-half of the volume of air flowing through the first air conduit during a defrost cycle of operation.

15. A method according to claim 12 wherein the total volume of air flowing through the first and second air conduits during a defrost cycle of operation is less than the total volume of air flowing through the first and second air conduits during a refrigeration cycle of operation.

16. A method according to claim 12 wherein during a refrigeration cycle of operation, the air emitted from the outlet opening of the first air conduit is between 17° and 27° F., the air emitted from the outlet opening of the second air conduit is between 33° and 43° F. and the air received by the inlet opening of the first air conduit is between 30° and 40° F.

17. A method according to claim 12, 13, 14 or 15 wherein during a refrigeration cycle of operation the maximum air flow through the first air conduit is between 350 and 425 CFM and the air flow through the second air conduit is between 125 and 150 CFM and during a defrost cycle of operation the air flow through the first air conduit is between 200 and 300 CFM and the air flow through the second air conduit is between 125 and 175 CFM.

18. A refrigerated display case for displaying refrigerated products, said display case comprising:

a cabinet having an interior display space and an access opening for enabling access to refrigerated products within said display case;

a first air conduit extending around said cabinet so as to have an inlet opening at one end of said access opening and an outlet opening at the other end of said access opening, said inlet and outlet openings being aligned so that air leaving said outlet opening is directed across said access opening and received by said inlet opening;

refrigeration means arranged within said first air conduit for refrigerating air passing through said first air conduit;

air circulating means arranged within said first air conduit for circulating air through said first air conduit in a forward direction during a refrigeration cycle of operation so that air is expelled from said outlet opening, travels across said access opening and returns into said first air conduit through said inlet opening and for circulating such air in a reverse direction during a defrost cycle of operation so that air is expelled through said inlet opening;

a second air conduit extending partially around said cabinet in a position lying outwardly of said first air conduit, said second air conduit having an outlet opening arranged adjacent to said outlet opening of said first air conduit and an air inlet opening located so that during a refrigeration cycle of operation such inlet opening receives air passing through said first air conduit before such air passes through said refrigeration means;

control means for switching between a refrigeration cycle of operation and a defrost cycle of operation and during such defrost cycle of operation temporarily terminating the operation of said refrigeration means and causing said air circulating means to circulate air through said first air conduit in a reverse direction for causing ambient air to be drawn into said outlet openings of said first and second air conduits;

said second air conduit is arranged so that the ambient air flowing through said second air conduit during a defrost cycle of operation assists in the defrosting of said refrigeration means by transferring heat to the air flowing through said first air conduit by conduction and convection; and, means arranged within said second air conduit for partially restricting the flow of air therethrough during a refrigeration cycle of operation such that the resistance to such air flow is at least as great as the resistance to air flow through said refrigeration means in said first air conduit when said refrigeration means is substantially free of frost buildup.

19. A refrigerated display case according to claim 18 wherein during a defrost cycle of operation, the air flowing through said first air conduit is emitted from said first air conduit through said inlet opening of said first air conduit in a direction away from said display case.

20. A refrigerated display case according to claim 18 wherein said air circulating means includes at least one fan arranged within said first air conduit and said fan is arranged so that during a defrost cycle of operation it draws in air through said outlet openings of said first air conduit and said second air conduit for circulation through said first air conduit and said second air conduit.

21. A refrigerated display case according to claim 20 wherein said first air conduit and said second air conduit are constructed such that the volume of air flowing through said second air conduit during at least a portion of a defrost cycle of operation is greater than the volume of air flowing through said second air conduit during a refrigeration cycle of operation.

22. A refrigerated display case according to claim 20 wherein said first air conduit and said second air conduit are constructed such that during a refrigeration cycle of operation, the volume of air flowing through said second air conduit is approximately one-third of the volume of air flowing through said first air conduit and during a defrost cycle of operation the volume of air flowing through said second air conduit is at least one-half of the volume of air flowing through said first air conduit.

* * * * *

UNITED STATES PATENT AND TRADEMARK OFFICE

CERTIFICATE OF CORRECTION

PATENT NO. : 4,314,453

DATED : February 9, 1982

INVENTOR(S) : Fayez F. Ibrahim

It is certified that error appears in the above-identified patent and that said Letters Patent is hereby corrected as shown below:

On the Title page please change the name of Inventor from "Fayez F. Abraham" to --Fayez F. Ibrahim--.

Signed and Sealed this

*Thirtieth* Day of *July 1985*

[SEAL]

*Attest:*

DONALD J. QUIGG

*Attesting Officer* *Acting Commissioner of Patents and Trademarks*